United States Patent [19]

Mandrin

[11] Patent Number: 4,903,496

[45] Date of Patent: Feb. 27, 1990

[54] PLANT AND METHOD FOR PERIODIC CHARGING AND DISCHARGING OF A GAS RESERVOIR

[75] Inventor: Charles Mandrin, Winterthur, Switzerland

[73] Assignee: Sulzer Brothers Limited, Winterthur, Switzerland

[21] Appl. No.: 316,930

[22] Filed: Feb. 28, 1989

[30] Foreign Application Priority Data

Mar. 4, 1988 [CH] Switzerland ..... 00827/88-3

[51] Int. Cl.[4] ..... F25B 9/00

[52] U.S. Cl. ..... 62/87; 62/402; 62/434

[58] Field of Search ..... 62/87, 434, 402

[56] References Cited

U.S. PATENT DOCUMENTS

| | | | |
|---|---|---|---|
| 3,154,928 | 11/1964 | Harmens | 62/87 |
| 3,209,552 | 10/1965 | Garrett | 62/87 |
| 3,992,891 | 11/1976 | Pocrnja | 62/87 |
| 4,716,737 | 1/1988 | Mandrin | 62/87 |

FOREIGN PATENT DOCUMENTS

| | | |
|---|---|---|
| 0237942 | 9/1987 | European Pat. Off. . |
| 2931635 | 2/1981 | Fed. Rep. of Germany . |

OTHER PUBLICATIONS

Linde Berichte Aus Technik Und Wissenschaft, No. 54, 1984 Mainz/Costheim, Germany, U. Rathmann, et al.: Vergleich verschiedener Erdgasverflussigungsprozesse und unterschiedliher Antriebe fur Peakshaving-Anlagen (1.Teil) pp. 3 to 17.

*Primary Examiner*—Ronald C. Capossela
*Attorney, Agent, or Firm*—Kenyon & Kenyon

[57] ABSTRACT

The plant for the periodic charging and discharging of a gas reservoir comprises a gas circuit containing a compressor and a heat exchanger. A line for supplying the gas for storage and for discharging stored gas to a consumer is connected to the gas circuit. The gas is stored as a gas at low temperature and elevated pressure or as a liquid gas at substantially ambient pressure. A heat exchanger disposed in the gas circuit is operated as a cooler or heater depending on whether gas is to be stored or discharged. The heat-transfer or refrigerant liquid flowing through the heat exchanger is either cooled in a refrigerating machine or heated in a heater. Depending upon requirements, a gas, e.g. natural gas, can be prepared in one and the same plant for charging a reservoir or for emptying the same.

13 Claims, 7 Drawing Sheets

42
6
e
43
41
40
44
49
48
46
7'
3
8'
7
1
45
8
16
15
2
50
17
4
a
9
11'
51
47
52
10
53
54

PLANT AND METHOD FOR PERIODIC CHARGING AND DISCHARGING OF A GAS RESERVOIR

This invention relates plant and method for periodic charging and discharging of a gas reservoir.

Heretofore, various types of techniques have been employed for storing gas for future use. In some cases, the gas has been transported, such as by pipeline to a storage tank and stored, for example under pressure. Subsequently, the gas is discharged over other pipelines for use by an ultimate consumer.

It is an object of this invention to treat a gas for both storage and for delivery to consumers in a single plant in an economic manner.

It is another object of in the invention to provide a plant of the most compact possible construction for the storage and discharge of gas.

It is another object of the invention to provide a plant for periodically charging and discharging a gas reservoir which is capable of using standard units.

Briefly, the invention provides a plant for the periodic charging and discharging of a gas reservoir which includes a gas circuit having at least one compressor for compressing a flow of gas and at least one heat exchanger for the flow of gas. In addition, at least one line extends from the gas circuit for connection to a gas reservoir for conveying gas therebetween while at least a second line is in communication with the gas circuit for selectively supplying and discharging gas from the gas circuit. Still further, a secondary circuit is connected to the heat exchanger for passing a heat exchange medium therethrough in heat exchange with the flow of gas. This secondary circuit includes a refrigerating machine for selectively cooling the heat exchange medium to effect cooling of the gas flow in the heat exchanger and a heater connected in parallel with the refrigerating machine for selectively heating the heat exchange medium to effect heating of the gas flow in the heat exchanger.

The invention also provides a method of charging a gas reservoir which includes the steps of obtaining a flow of gas from a gas source, compressing the flow of gas and thereafter cooling the gas in heat exchange relation with a refrigerated heat exchange medium passing through a closed circuit prior to feeding of the cooled flow of gas into a gas reservoir for storage at a higher pressure and lower temperature than the gas source.

The invention also provides a method of discharging cold gas stored under pressure. This method includes the steps of mixing a flow of stored cold gas with a flow of hot gas circulating in a gas circuit in order to obtain a gas mixture, heating the gas mixture and thereafter supplying some of the heated gas mixture to a consumer. The remainder of the heated gas mixture is compressed in the gas circuit and is thereafter heated in heat exchange relation with a heated heat exchange medium passing through the closed circuit.

The gas which is delivered to a consumer is at an ambient temperature and a lower pressure than the reservoir pressure.

In accordance with the invention, the charging of gas into the gas reservoir may be carried out during times when there is no gas demand by consumers or only a slight gas demand by consumers. The discharging of the gas reservoir may take place mainly at times when there is a high gas demand which can no longer be satisfied by the available gas source.

The plant and method may be used where large quantities of gas can be stored in natural or artificial caves, tanks or the like.

Although one essential area of application is the charging and discharging of natural gas reservoirs, the plant and method may be equally successfully applied to the storage of large quantities of other industrial gases such a ammonia, nitrogen and chlorine.

For economic considerations, the gas, for example, natural gas, is stored at high density. In this respect, two possibilities exist. First, the natural gas may be stored at a high pressure of about 150 bars and at a low temperature of about −70° C. Under these conditions, this corresponds to a natural gas density of about 280 kilograms per cubic meter. The second possibility is to store natural gas in liquid form. In this case, the natural gas has a density of about 450 to 500 kilograms per cubic meter and is virtually independent of the pressure. Liquid gas reservoirs are therefore usually designed for a pressure of 1 to about 1.5 bars.

These and other objects and advantages of the invention will become more apparent from the following detailed description taken in conjunction with the accompanying drawings wherein.

Figure 1:
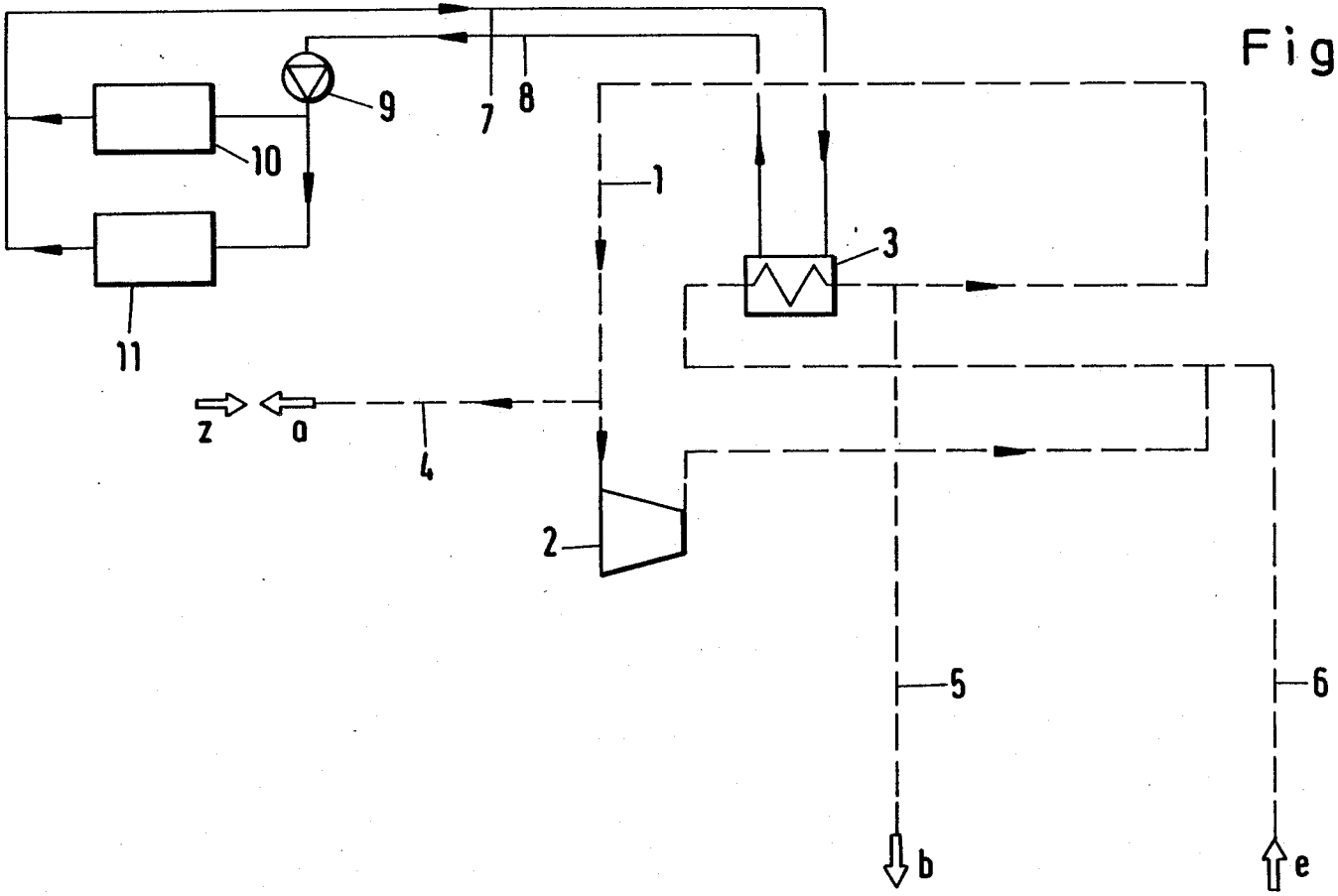
FIG. 1 illustrates a first embodiment of a plant constructed in accordance with the invention.

Referring to FIG. 1, the plant comprises a gas circuit 1 containing a compressor 2 for compressing a flow of gas and a heat exchanger 3 for the flow of gas. A line 4 is connected to the gas circuit on the intake side of the compressor 2 for supplying gas in the direction of arrow z from the gas source (not shown) during the charging of the gas reservoir (not shown), and for feeding the gas in the direction of the arrow a to a consumer, e.g. a pipeline in the case of natural gas, during discharging of the gas reservoir.

During charging of the gas reservoir, compressed gas cooled in the heat exchanger 3 is fed to the gas reservoir in the direction of arrow b via a line 5 extending form the gas circuit.

During discharge of the gas reservoir, gas is fed to the gas circuit from the gas reservoir in the direction of the arrow a via a line 6.

During storage, the gas is cooled by heat exchange in the heat exchanger 3 by means of a special heat exchange medium such as a heat-transfer or refrigerant liquid cycled through a secondary circuit having a feed line 7 and a discharge line 8 containing a feed pump 9.

The secondary circuit includes a standard refrigerating machine 10 to cool the heat transfer or refrigerant liquid, for example, a UNITOP (registered trade mark) refrigerating machine or UNITURBO (registered trade mark) refrigerating machine. Refrigerating machines of this kind usually consist of a water-cooled condenser, an expansion valve, an evaporator which cools cold water (with or without anti-freeze agents) or another liquid, and a single or two-stage compressor with a transmission and electric motor drive. Suitable heat-transfer or refrigerant liquids are those which have a partial pressure of less than 2 bars at 200° C., a viscosity of less than 10 cP at −30° C., and no appreciable corrosion of stainless steel at 100° C., and no appreciable decomposition at 150° C. Liquids which have these properties are, for example, Dowtherm J (registered trade mark) of Dow Chemical, Paracryol (registered trade mark Sulzer Brothers Limited) or a methanol-water mixture or a glycol-water mixture.

While heat-transfer or refrigerant liquid cooled in the refrigerating machine 10 flows through the heat exchanger 3 during the storage of gas, the stored gas must be heated in the heat exchanger 3 during discharge of the gas reservoir.

To this end, a heat-transfer liquid, advantageously the same as used for cooling, is heated to the required temperature in a heater 11 in the secondary circuit and fed to the heat exchanger 3.

The heater 11 is connected in parallel with the refrigerating machine 10 via suitable valve means (not shown) so as to be selectively operated. The heater 11 may, for example, be in the form of a fired heater, an electrical heater, or a counter-current heat exchanger in which the liquid is heated with hot water. Alternatively, the heater 11 can be constructed as a vapor condenser, the liquid for heating flowing through tubes and the vapor condensing on the outer surfaces thereof.

Figure 2:
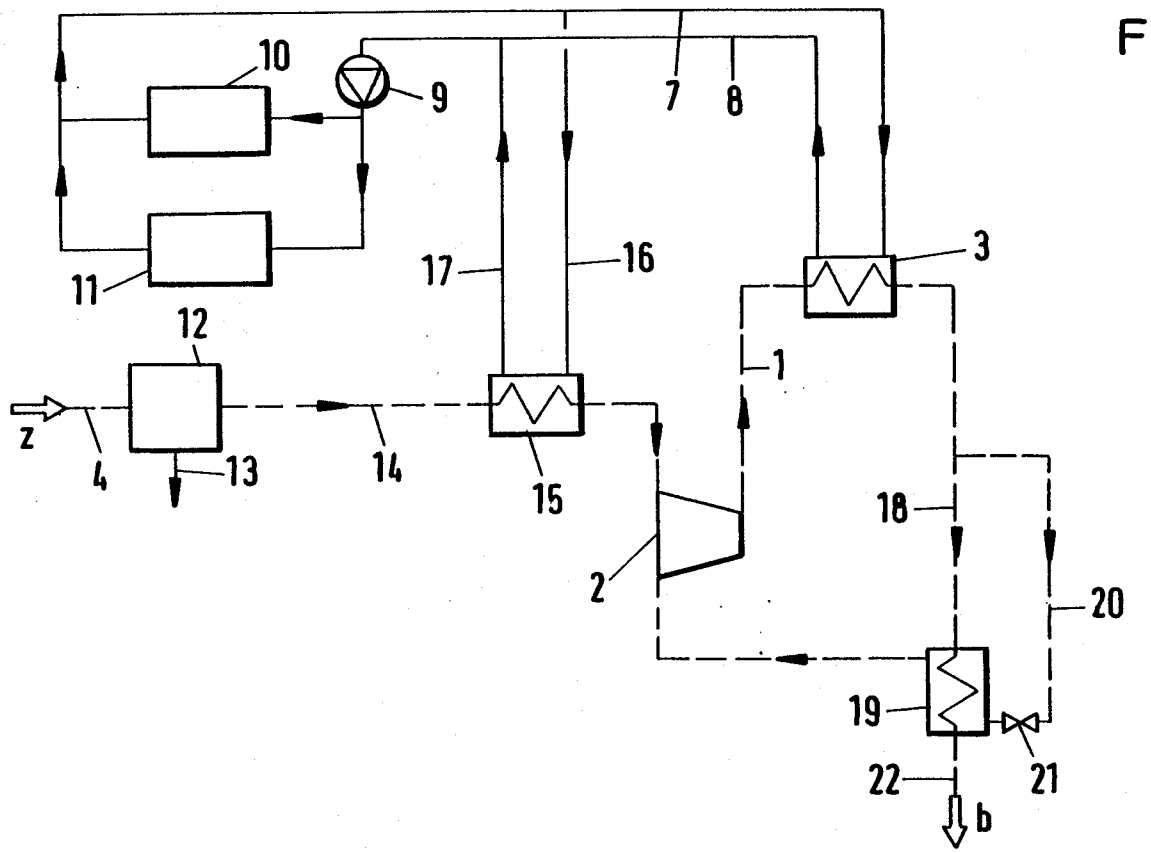
FIG. 2 illustrates a modified plant in accordance with the invention.
Figure 7:
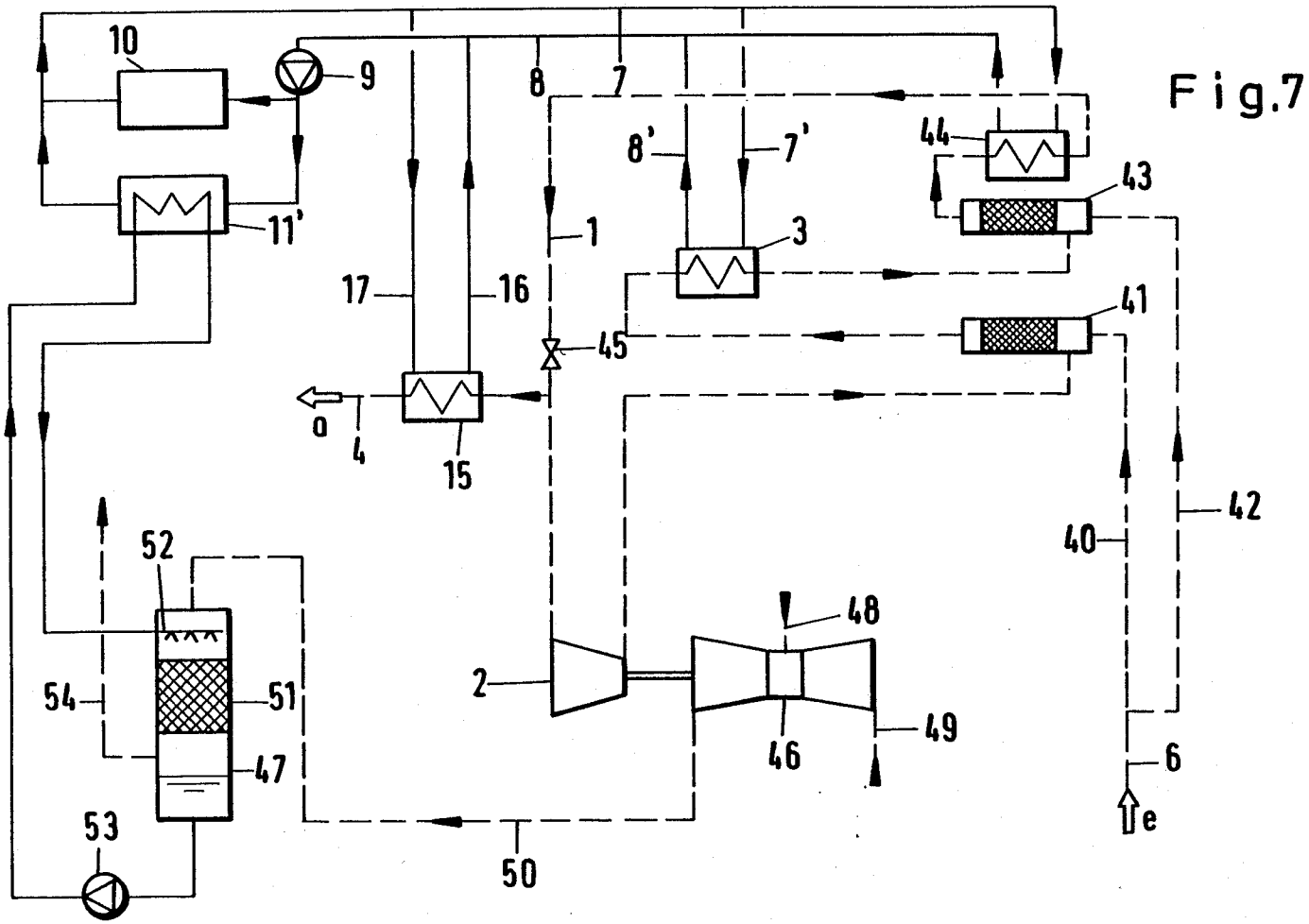
FIG. 7 illustrates a modified plant for the charge of gas from a gas reservoir in accordance with the invention.

The elements corresponding to the plant elements in FIG. 1, e.g. the refrigerating machine, heater, heat exchanger, compressor, lines and the like have the same references in FIGS. 2 and 7.

For the sake of clarity, those exemplified embodiments in which only the charging of the gas reservoir is explained have only the relevant plant elements shown (FIGS. 2 to 5), while those exemplified embodiments in which the discharge of the gas reservoir is explained have only those relevant plant elements shown.

Since the plant is capable of both charging and discharging of the gas reservoir, the plant naturally has all the plant elements required for charging and discharging.

Referring to FIG. 2, the gas reservoir (not shown) is charged with natural gas as follows: natural gas is fed into the plant via line 4 and the water contained in the natural gas is separated therefrom in a drier 12 of known construction and is discharged via a line 13. Without this step, any traces of water still contained in the natural gas could ice up and clog the downstream plant elements. The natural gas is then introduced into a heat exchanger 15 connected in parallel with the heat exchanger 3 in the secondary circuit via a line 14. The natural gas is pre-cooled in the heat exchanger 15 by means of the heat-transfer or refrigerant liquid cooled in the refrigerating machine 10. This liquid is introduced into the heat exchanger (precooler) 15 via a line 16 connected to the line 7 and leaves via a line 17 connected to the line 8. The attainable precooling temperature is basically governed by the capacity of the refrigerating machine 10 and the properties of the heat-transfer or refrigerant liquid.

The natural gas is compressed to the pressure required for storage by the compressor 2 which is hereinafter referred to as the main compressor. Where natural gas is stored in the gas reservoir in gas form, this compressor 2 is the only one essential for performing charging and discharging. The compressed natural gas is cooled further in the heat exchanger 3 and some is fed via a line 18 of the gas circuit to a counter-current heat exchanger 19. The remainder of the cooled and compressed gas is branched out of the gas circuit via a branch line 20, expanded in a throttle valve 21 using the Joule-Thompson effect for further cooling and fed into the heat exchanger 19 for cooling the flow of gas from the line 18. The natural gas cooled to the storage temperature by heat exchange in the heat exchanger 19 is introduced into the gas reservoir via a line 22 in the direction indicated by arrow b.

Figure 3:
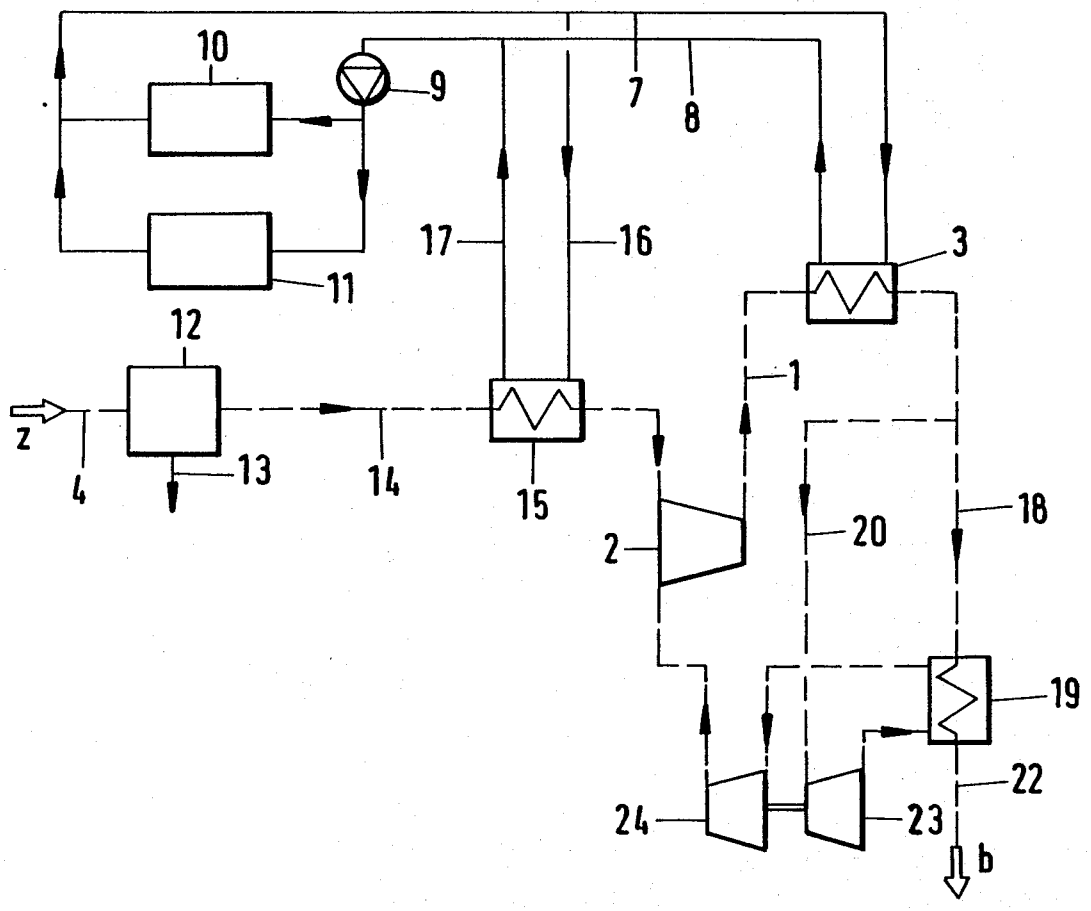
FIG. 3 illustrates a plant similar to FIG. 2 employing a turbine-compressor arrangement for a second stage cooling of the gas discharged from the gas circuit in accordance with the invention.

The plant shown in FIG. 3 differs from FIG. 2 only in that the compressed gas branched off from the gas circuit via line 20 is expanded, not in a throttle valve, but in an expansion turbine 23, being cooled at the same time. The expansion turbine 23 drives a compressor 24. During heat exchange, this compressor 24 draws heated gas out of the heat exchanger 19 and compresses the gas to the intake pressure of the main compressor 2.

Figure 4:
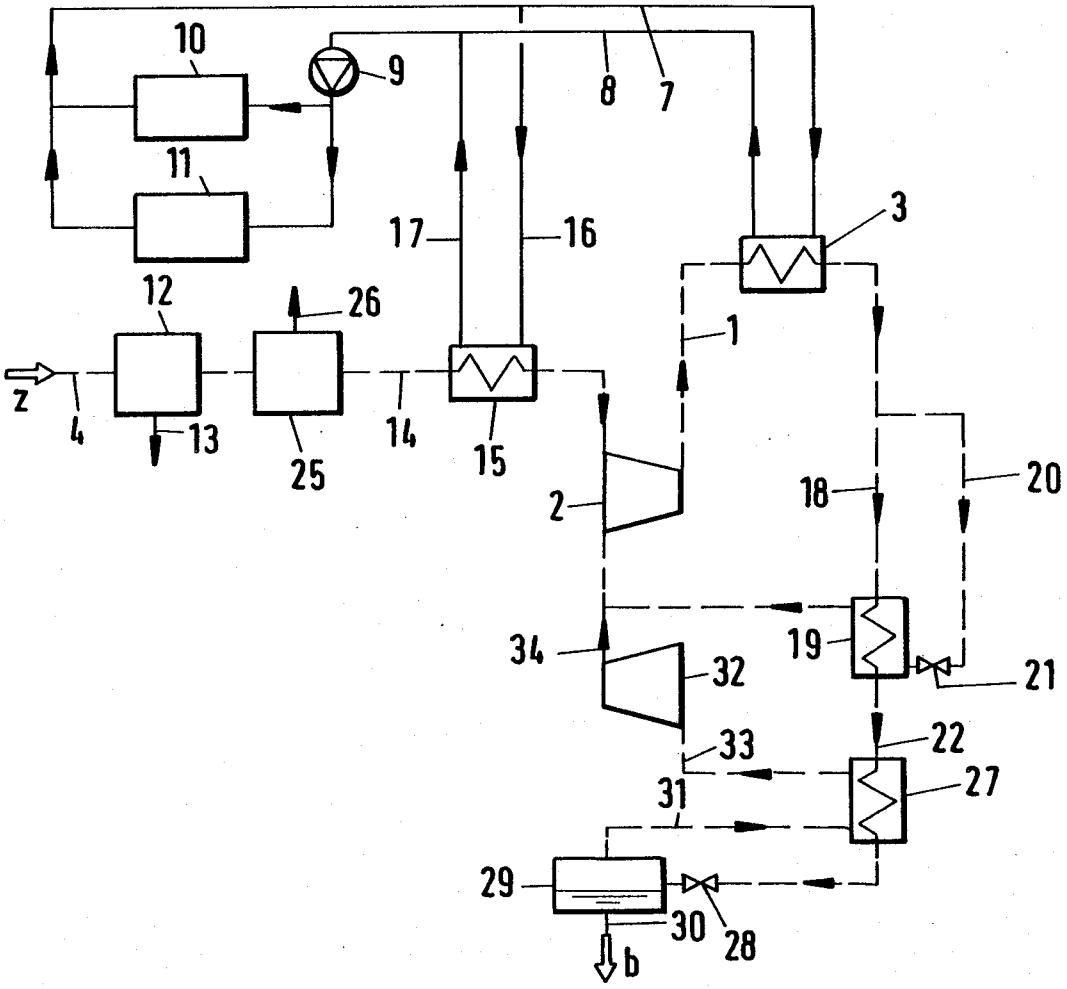
FIG. 4 illustrates a modified plant for the storing of gas in liquid form.

The plant shown in FIG. 4 differs form that shown in FIGS. 2 and 3 basically in that the natural gas is to be stored in liquid form in a liquid gas reservoir (not shown).

After the water contained in the gas for storage has been separated in the drier 12, the gas is fed to a separator 25 for the separation of carbon dioxide. Separators of this kind are known and may be constructed, for example as a chemical carbon dioxide washing plant or as a molecular sieve plant. The carbon dioxide is discharged from the plant via a line 26. This step is taken to prevent the downstream plant elements from being clogged with solid carbon dioxide.

After the compressed gas has been cooled in the heat exchanger 19, the gas is cooled further in a counter-current heat exchanger 27 and then expanded in a throttle valve 28 (Joule-Thompson effect), the gas partially liquefying. The mixture of liquid and gas is then fed to a tank 29. The liquefied natural gas is fed into a liquid gas reservoir (not shown) via a line 30 in the direction of arrow b.

The unliquefied natural gas and any other inert gases are fed via a line 31 to the heat exchanger 27, in which they heat up. The gas is then drawn in by a compressor 32 via a line 33 and compressed to the intake pressure of the main compressor 2 and fed via a line 34 to the gas circuit on the intake side of the main compressor 2.

Figure 5:
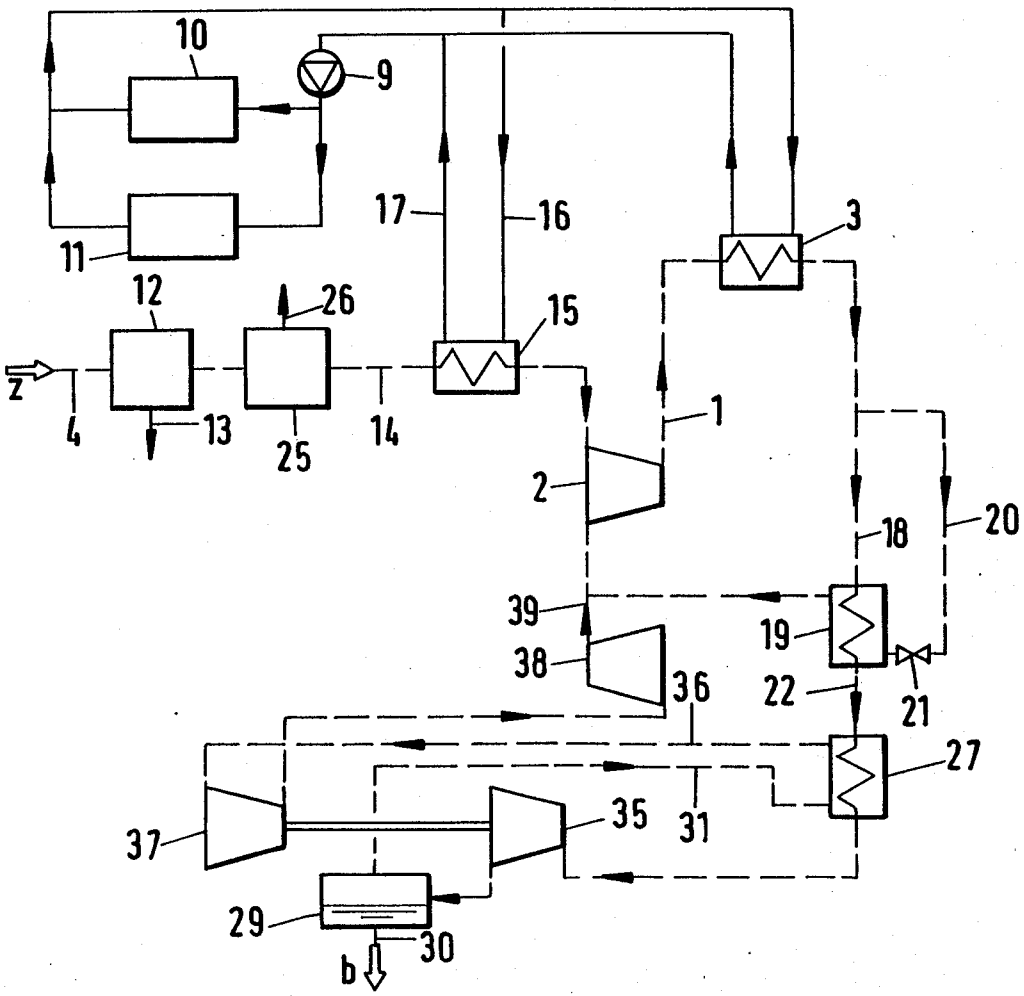
FIG. 5 illustrates a plant similar to FIG. 2 employing a turbine compressor arrangement for the cooling of the gas discharged from the gas circuit into liquefied form.

In the plant shown in FIG. 5, the natural gas is stored in the liquid state in a similar manner to FIG. 4. Contrary to the latter, however, the natural gas cooled in the heat exchanger 27 is expanded in a turbine 35, the gas partially liquefying and then being fed to the tank 29. The unliquefied natural gas and any inert gases still present are then also fed to the heat exchanger 27 from the tank 29 via a line 31 and heated therein. The heated natural gas is then drawn in by a compressor 37 via a line 36 and compressed. This compressor 37 is driven by the expansion turbine 35. Another compressor 38 is connected in series with compressor 37 and compresses the natural gas to the intake pressure of the main compressor 2 of the gas circuit 1 and feeds the gas via a line 39 to the gas circuit 1.

The discharge of stored gas, e.g. natural gas, will now be described with reference to exemplified embodiments relating to the plants shown in FIGS. 6 and 7.

Those elements which are the same as plant elements shown in FIGS. 1 to 5 have the same reference numerals in FIG. 5.

In this connection, it is immaterial whether the natural gas is stored as liquid gas or in gas form in the reservoir.

If the natural gas is stored in liquid form, a pump unit (not shown) pumps the liquid to the exit pressure of the main compressor and feeds the liquefied gas into the plant via the line 6.

Some of the cold gas or cold liquid is fed together with compressed hot circuit gas via a line 40 to a mixer 41 which may, for example, be a static mixer. The circuit gas is heated by the compression heat of the main compressor 2.

The temperature of the gas mixture leaving the mixer 41 must not be lower than the lowest temperature that the refrigerating machine 10 can generate, since otherwise the heat-transfer or refrigerant liquid might become too viscous or even freeze up in the heat exchanger 3. In the present case, the heat exchanger 3 operates as a heating element for the gas mixture. To this end, instead of the refrigerating machine 10, the heater 11 is switched on and heats the heat-transfer or refrigerant liquid to the required temperature, the liquid being fed via lines 7, 7' to the heat exchanger 3, and, after heat exchange, recycled to the heater 11 Via the lines 8', 8.

Since, in many cases, the cold gas or liquid gas for storage cannot be brought to the required temperature level in the above-described step (mixer 41 and heat exchanger 3), because of the lowest temperature limit referred to above, this process must be performed in a number of steps.

In the exemplified embodiment, only a second step is shown, but of course a plurality of such steps can be used.

Figure 6:
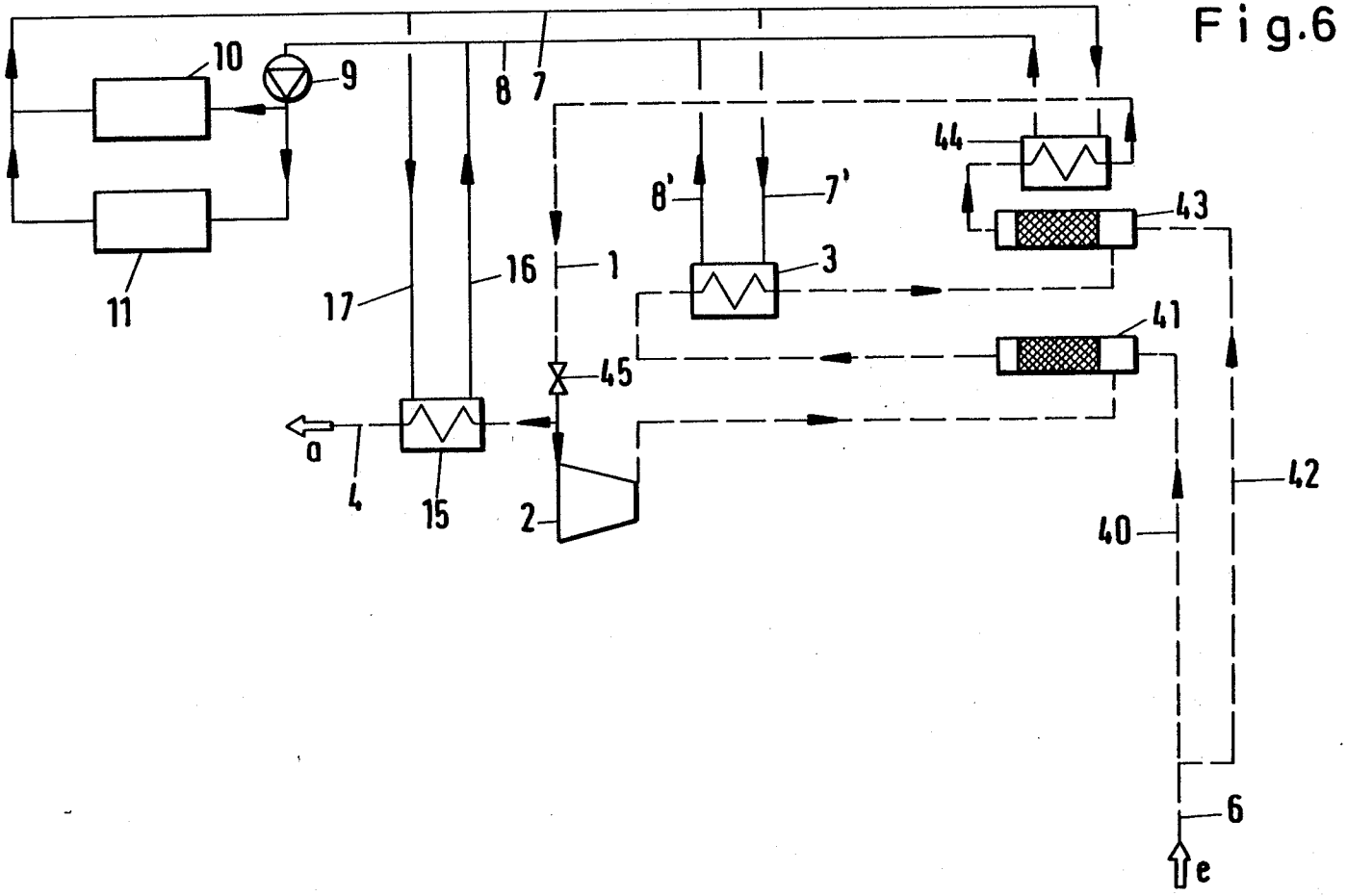
FIG. 6 illustrates a plant for the heating of gas discharged from a gas reservoir in accordance with the invention.

In FIG. 6, the remaining cold gas or liquid gas is withdrawn from line 6 via line 42 and mixed with heated circuit gas in a second mixer 43. The gas mixture, which has the lowest temperature in the gas circuit, is then heated in a heat exchanger 44, through which heated heat-transfer or refrigerant liquid flows, and then expanded in a valve 45 to the intake pressure of the main compressor 2. This intake pressure is identical with the consumer pressure, e.g. the pressure of a pipeline system. The amount of gas to be fed to a consumer is withdrawn from the circuit 1 and heated to the consumer temperature e.g. ambient temperature, in the heat exchanger 15 which, in this case, acts as a heating element, and is fed to the consumer via the line 4 in the direction of the arrow a.

Like FIG. 6, the plant shown in FIG. 7 relates to the discharge of a cold gas or liquid gas reservoir. The difference consists basically in a particular construction of the heating device for the heat-transfer or refrigerant liquid.

In the present case, the main compressor 2 is driven by a gas turbine 46. A known type of washing column 47 is used for the recovery of the gas turbine waste heat. The gas turbine 46 is fed with air via a connection 48 and with fuel, e.g. natural gas, via a connection 49. In addition to the mechanical driving power for the main compressor 2, the gas turbine 46 delivers waste gases which are fed to the column 47 via a line 50. These waste gases which, for example, have a temperature of about 450° to 550° C., contain oxygen, nitrogen, carbon dioxide and an appreciable proportion of water vapor forming on combustion of the fuel.

The column 47 contains a liquid/gas contact device 51 which, for example, may consist of a static mixer or a column packing of known construction. The heating device 11' is in this case constructed as a heat exchanger and is connected via a circuit to opposite ends of the column 47. Water from this heat exchanger, for example at a temperature of 20° C., is sprayed on to the contact device 51 in the column 47 by a distributor 52. Direct heat exchange with the waste gases results in a slightly heated-up water at a temperature of about 30° C. forming in the sump of the column 47 and this is delivered by pump 53 to the heat exchanger 11'. The water is then cooled to a temperature, for example, of about 20° C. in countercurrent to the heat-transfer or refrigerant liquid. The heated heat-transfer or refrigerant liquid is fed into the line 7.

The waste gas leaving the column 47 via line 54 has the same temperature as the sump of the column 47, e.g. 30° C.

At temperatures as low as this, most of the combustion water condenses and generates additional heat which is recovered in the heat exchangers 11', 15, 3, and 44. Condensation of the combustion water results in an excess of liquid in the column 47, so that liquid must be periodically or continuously emptied from the column via a line (not shown). The washing plant does not therefore consume any water and therefore requires no water treatment.

In conclusion, it should be noted that instead of a refrigerating machine which cools the heat-transfer or refrigerant liquid, it is possible to use an absorption refrigeration plant. The gas turbine waste gas heat can advantageously be used as a heat source for this absorption refrigeration plant.

If the purpose of a plant is to compensate for periodic and intensive consumer fluctuations, as is frequently the case, fully automatic plant operation is advantageous. Fully automatic change-over from charging to discharging of gas, and vice versa, is very advantageous economically and is greatly facilitated if the same heat-transfer or refrigerant liquid is used both for charging and discharging a reservoir, since in that case the liquid pipes do not have to be emptied between charging and discharging of the reservoir.

The invention thus provides a plant of compact construction which can be economically operated for the periodic charging and discharging of a gas reservoir.

The invention also provides a method for the charging and/or discharging of a gas reservoir in an efficient cost-effective manner.

What is claimed is:

1. A plant for the periodic charging and discharging of a gas reservoir, said plant comprising a gas circuit having at least one compressor for compressing a flow of gas and at least one heat exchanger for the flow of gas;

at least one line extending from said gas circuit for connection to a gas reservoir for conveying gas therebetween;

at least a second line in communication with said gas circuit for selectively supplying and discharging gas from said circuit; and a secondary circuit connected to said heat exchanger for passing a heat exchange medium therethrough in heat exchange with the flow of gas therethrough, said secondary circuit including a refrigerating machine for selectively cooling the heat exchange medium to effect cooling of the gas flow in said heat exchanger and a heater connected in parallel with said refrigerating machine for selectively heating the heat exchange medium to effect heating of the gas flow in said heat exchanger.

2. A plant as set forth in claim 1 which further comprises at least one static mixer in said gas circuit for passage of the gas flow therethrough and a line communicating said static mixer with the gas reservoir to pass stored gas from the reservoir into said mixer in co-current with the gas flow.

3. A plant as set forth in claim 1 which further comprises a second heat exchanger in said second line and connected in parallel with said one heat exchanger for passage of the heat exchange medium therethrough in heat exchange with the flow of gas in said second line.

4. A plant as set forth in claim 1 which further comprises a first countercurrent heat exchanger connected between and to said gas circuit and said one line for conveying a flow of compressed gas into said one line for passage to the gas reservoir, said circuit having a branch line connected to said countercurrent heat exchanger to pass a flow of gas in said circuit through said countercurrent heat exchanger in heat exchange with the flow of compressed gas to said one line, and an expansion element in said branch line for expanding gas passing therethrough, said branch line extending from said countercurrent heat exchanger to said compressor to pass a flow of gas thereto.

5. A plant as set forth in claim 4 which further comprises a second countercurrent heat exchanger connected to a downstream side of said first countercurrent heat exchanger to receive a flow of compressed gas therefrom;

a line extending from said second countercurrent heat exchanger to convey compressed gas therefrom;

an expansion element in said latter line for expanding gas passing therethrough;

a tank connected to said latter line to receive liquefied gas therefrom, said tank being connected to said one line to deliver liquefied gas to the reservoir;

a connecting line connecting said tank with said second countercurrent heat exchanger to deliver a flow of gas from said tank thereto in countercurrent to the flow of compressed gas therein;

a second compressor connected to and between said second countercurrent heat exchanger and said compressor of said gas circuit to deliver a compressed flow of gas from said second countercurrent heat exchanger to said compressor of said gas circuit.

6. A plant as set forth in claim 1 which further comprises a gas turbine drivingly connected to said compressor;

a waste gas line extending from said turbine to exhaust hot waste gas therefrom;

a washing column connected to said waste gas line to receive waste gas for washing in said column;

a third circuit connecting said column at opposite vertical ends with said heater for circulating a washing liquid therethrough; and a feed pump in said third circuit for pumping the washing liquid therethrough.

7. A method of charging a gas reservoir comprising the steps of obtaining a flow of gas from a gas source;

compressing the flow of gas;

cooling the flow of gas in heat exchange relation with a refrigerated heat exchange medium passing through a closed circuit; and feeding the cooled flow of gas into a gas reservoir for storage at a higher pressure and lower temperature than the gas source.

8. A method as set forth in claim 7 which further comprises the steps of expanding a first part of the cooled flow of gas, re-cooling a second part of the cooled flow of gas in indirect heat exchange with the expanded first part, and feeding the re-cooled second part to the gas reservoir while recycling the first part for compressing with a flow of gas from the gas source.

9. A method of discharging cold gas stored under pressure comprising the steps of mixing of flow of stored cold gas with a flow of hot gas circulating in a gas circuit to obtain a gas mixture;

heating the gas mixture;

supplying some of the heated gas mixture to a consumer;

compressing the remainder of the heated gas mixture in the gas circuit; and thereafter heating the compressed gas in the gas circuit in heat exchange relation with a heated heat exchange medium passing through a closed circuit.

10. A method as set forth in claim 9 which further comprises the steps of mixing the flow of stored cool gas with the flow of hot gas in a plurality of mixing stages connected in series in the gas circuit;

heating each mixture of cold gas and hot gas downstream of each mixing stage; and supplying the cold gas to each stage in a quantity sufficient to maintain the temperature of each mixture above a preselected minimum value.

11. A method as set forth in claim 9 which further comprises the steps of compressing the flow of gas in the gas circuit with a gas compressor;

driving the gas compressor with a gas turbine;

passing a flow of hot waste gas from the gas turbine into heat exchange with a flow of water in a closed circuit to transfer heat thereto; and transferring the heat in said closed circuit to the gas mixture in said gas circuit.

12. A method as set forth in claim 9 wherein the heat exchange medium is a liquid having a partial pressure of less than 2 bars at 200° C., a viscosity of less than 10 cP at −30° C., and no appreciable corrosion of stainless steel at 100° C. and no appreciable decomposition at 150° C.

13. A method as set forth in claim 12 wherein the liquid is selected from the group consisting of Dowtherm J, Paracryol, a methanol-water mixture or a glycolwater mixture.

* * * * *

UNITED STATES PATENT AND TRADEMARK OFFICE

CERTIFICATE OF CORRECTION

PATENT NO. : 4,903,496

DATED : Feb. 27, 1990

INVENTOR(S) : CHARLES MANDRIN

It is certified that error appears in the above-identified patent and that said Letters Patent is hereby corrected as shown below:

Column 1, line 1 "relates plant" should be -relates to a plant-
Column 1, line 17 "of in the" should be -of the-
Column 2, line 10 "a" should be -as-
Column 2, line 59 "form" should be -from-
Column 4, line 37 "example as" should be -example, as-
Column 5, line 32 "Via" should be -via-
Column 5, line 57 "a" should be -a-

Signed and Sealed this

Twentieth Day of August, 1991

*Attest:*

*Attesting Officer*

HARRY F. MANBECK, JR.

*Commissioner of Patents and Trademarks*